US010876531B2

(12) United States Patent
Novak et al.

(10) Patent No.: US 10,876,531 B2
(45) Date of Patent: Dec. 29, 2020

(54) LUBRICANT INJECTION FOR A SCREW COMPRESSOR

(71) Applicant: TRANE INTERNATIONAL INC., Davidson, NC (US)

(72) Inventors: Keith Adam Novak, La Crosse, WI (US); Alberto Scala, Onalaska, WI (US); Timothy S. Hagen, Onalaska, WI (US); Brian Hemmersbach, Sparta, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 65 days.

(21) Appl. No.: 16/232,717

(22) Filed: Dec. 26, 2018

(65) Prior Publication Data

US 2020/0208638 A1 Jul. 2, 2020

(51) Int. Cl.
*F04C 29/02* (2006.01)
*F04C 18/16* (2006.01)
(Continued)

(52) U.S. Cl.
CPC ..... *F04C 29/028* (2013.01); *F04C 18/16* (2013.01); *F25B 31/004* (2013.01);
(Continued)

(58) Field of Classification Search
CPC .... F04C 29/028; F04C 18/16; F04C 2210/14; F04C 2210/26; F25B 31/002; F25B 31/004
See application file for complete search history.

(56) References Cited

U.S. PATENT DOCUMENTS 7,481,634 B2 1/2009 Candid et al.
8,708,677 B2 4/2014 Gotou et al.
(Continued)

FOREIGN PATENT DOCUMENTS

EP 2410182 A1 1/2012
GB 1237333 A 6/1971
(Continued)

OTHER PUBLICATIONS

Extended European Search Report; European Patent Application No. 19216632.0, dated Feb. 14, 2020 (9 pages).

*Primary Examiner* — Marc E Norman
(74) *Attorney, Agent, or Firm* — Hamre, Schumann, Mueller & Larson, P.C.

(57) ABSTRACT

A screw compressor, refrigerant circuit, lubrication method are disclosed. The screw compressor includes a suction inlet that receives a working fluid to be compressed. A compression mechanism is fluidly connected to the suction inlet. A discharge outlet is fluidly connected to the compression mechanism that outputs the working fluid following compression by the compression mechanism. The screw compressor includes a slide valve that is movable between a first position and a second position. The first position corresponds to a high volume ratio and the second position corresponds to a low volume ratio. The slide valve includes a plurality of lubricant passageways selectively connectable to a lubricant source. A first of the plurality of lubricant passageways is configured to be selected to provide lubricant at the high volume ratio, and a second of the plurality of lubricant passageways is configured to be selected to provide lubricant at the low volume ratio.

20 Claims, 5 Drawing Sheets

(51) Int. Cl.

| | |
|---|---|
| ***F25B 31/00*** | (2006.01) |
| *F25B 13/00* | (2006.01) |
| *F25B 43/02* | (2006.01) |

(52) U.S. Cl.
CPC ..... *F04C 2210/14* (2013.01); *F04C 2210/26* (2013.01); *F25B 13/00* (2013.01); *F25B 43/02* (2013.01)

(56) References Cited

U.S. PATENT DOCUMENTS

| | | | | |
|---|---|---|---|---|
| 8,858,192 | B2 * | 10/2014 | Shikano ..... | F04C 18/16 417/228 |
| 10,030,653 | B2 | 7/2018 | Kienzle | |
| 2014/0127067 | A1 | 5/2014 | Kienzle | |
| 2015/0093273 | A1 | 4/2015 | Johnson et al. | |

FOREIGN PATENT DOCUMENTS

| | | | |
|---|---|---|---|
| JP | S53-97710 | U | 8/1978 |
| JP | 57-140591 | A | 8/1982 |
| JP | H02-248678 | A | 10/1990 |

* cited by examiner

LUBRICANT INJECTION FOR A SCREW COMPRESSOR

FIELD

This disclosure relates generally to a vapor compression system. More specifically, this disclosure relates to lubrication for a compressor in a vapor compression system such as, but not limited to, a heating, ventilation, air conditioning, and refrigeration (HVACR) system.

BACKGROUND

One type of compressor for a vapor compression system is generally referred to as a screw compressor. A screw compressor generally includes one or more rotors (e.g., one or more rotary screws). Typically, a screw compressor includes a pair of rotors (e.g., two rotary screws) which rotate relative to each other to compress a working fluid such as, but not limited to, a refrigerant or the like.

SUMMARY

This disclosure relates generally to a vapor compression system. More specifically, this disclosure relates to lubrication for a compressor in a vapor compression system such as, but not limited to, a heating, ventilation, air conditioning, and refrigeration (HVACR) system.

In an embodiment, the compressor is a screw compressor. In an embodiment, the screw compressor is used in an HVACR system to compress a working fluid (e.g., a heat transfer fluid such as, but not limited to, a refrigerant or the like).

In an embodiment, the screw compressor can have a variable speed drive. The variable speed drive (which may also be referred to as a variable frequency drive) can be used, for example, to vary a capacity of the screw compressor.

A screw compressor is disclosed. The screw compressor includes a suction inlet that receives a working fluid to be compressed. A compression mechanism is fluidly connected to the suction inlet that compresses the working fluid. A discharge outlet is fluidly connected to the compression mechanism that outputs the working fluid following compression by the compression mechanism. The screw compressor includes a slide valve that is movable between a first position and a second position. The first position corresponds to a high volume ratio and the second position corresponds to a low volume ratio. The slide valve includes a plurality of lubricant passageways selectively connectable to a lubricant source. A first of the plurality of lubricant passageways is configured to be selected to provide lubricant at the high volume ratio. A second of the plurality of lubricant passageways is configured to be selected to provide lubricant at the low volume ratio.

A refrigerant circuit is also disclosed. The refrigerant circuit includes a compressor, a condenser, an expansion device (e.g. valve, orifice, or the like), and an evaporator fluidly connected. A lubricant source is selectively connectable to the compressor. The compressor includes a suction inlet that receives a working fluid to be compressed. A compression mechanism is fluidly connected to the suction inlet that compresses the working fluid. A discharge outlet is fluidly connected to the compression mechanism that outputs the working fluid following compression by the compression mechanism. The compressor includes a slide valve that is movable between a first position and a second position. The first position corresponds to a high volume ratio and the second position corresponds to a low volume ratio. The slide valve includes a plurality of lubricant passageways selectively connectable to the lubricant source. A first of the plurality of lubricant passageways is configured to be selected to provide lubricant at the high volume ratio. A second of the plurality of lubricant passageways is configured to be selected to provide lubricant at the low volume ratio.

A method for injecting lubricant to a compression chamber in a variable volume ratio screw compressor is also disclosed. The method includes aligning a first of a plurality of lubricant passageways in a slide valve of the screw compressor so that the first of the plurality of lubricant passageways is fluidly connected to a lubricant source of the screw compressor when the slide valve is in a first position. The method further includes aligning a second of the plurality of lubricant passageways in the slide valve of the screw compressor so that the second of the plurality of lubricant passageways is fluidly connected to the lubricant source of the screw compressor when the slide valve is in a second position.

BRIEF DESCRIPTION OF THE DRAWINGS

References are made to the accompanying drawings that form a part of this disclosure, and which illustrate embodiments in which the systems and methods described in this Specification can be practiced.

Like reference numbers represent like parts throughout.

DETAILED DESCRIPTION

This disclosure relates generally to a vapor compression system. More specifically, this disclosure relates to lubrication for a compressor in a vapor compression system such as, but not limited to, a heating, ventilation, air conditioning, and refrigeration (HVACR) system.

In an embodiment, a volume ratio of a compressor, as used in this Specification, is a ratio of a volume of working fluid at a start of a compression process to a volume of the working fluid at a start of discharging the working fluid. A fixed volume ratio compressor includes a ratio that is set, regardless of operating condition. A variable volume ratio can be modified during operation of the compressor (e.g., based on operating conditions, etc.).

In a screw compressor, lubricant may be provided to a rotor housing in which the screw rotors are disposed to lubricate and seal a mesh between the rotors. Typically, a lubricant pump is not desired, as it may add complexity to the screw compressor. Instead, a pressure differential can be utilized to provide the lubricant from a location at a relatively higher pressure than a location at which the lubricant is provided in the rotor housing. The lubricant will flow into the rotor housing when the pressure at an injection location is lower than a pressure in the lubricant source.

When the screw compressor is capable of operating at a relatively lower volume ratio and at a relatively higher volume ratio (e.g., a variable volume ratio compressor), during part load conditions a pressure differential (e.g., delta_P) may be relatively lower. This can lead to providing the lubricant at a location that is relatively closer to the suction port where the compression is still relatively limited. As a result, the screw compressor efficiency can be impacted. In some instances, a dual injection valve can be provided to switch between two lubricant locations. However, this can increase a complexity of the screw compressor.

Embodiments of this disclosure are directed to lubricant control utilizing a slide valve in the screw compressor that is used to control the volume ratio of the screw compressor. Utilizing the slide valve itself can result in a simpler screw compressor in which a single lubricant port is required. The slide valve can include lubricant passageways that are selectively fluidly connected to the lubricant source according to the state (e.g., high volume ratio or low volume ratio) of the slide valve. In an embodiment, including the plurality of lubricant passageways can, for example, enable an expanded operating map at low differential pressure relative to prior compressors.

Figure 1:
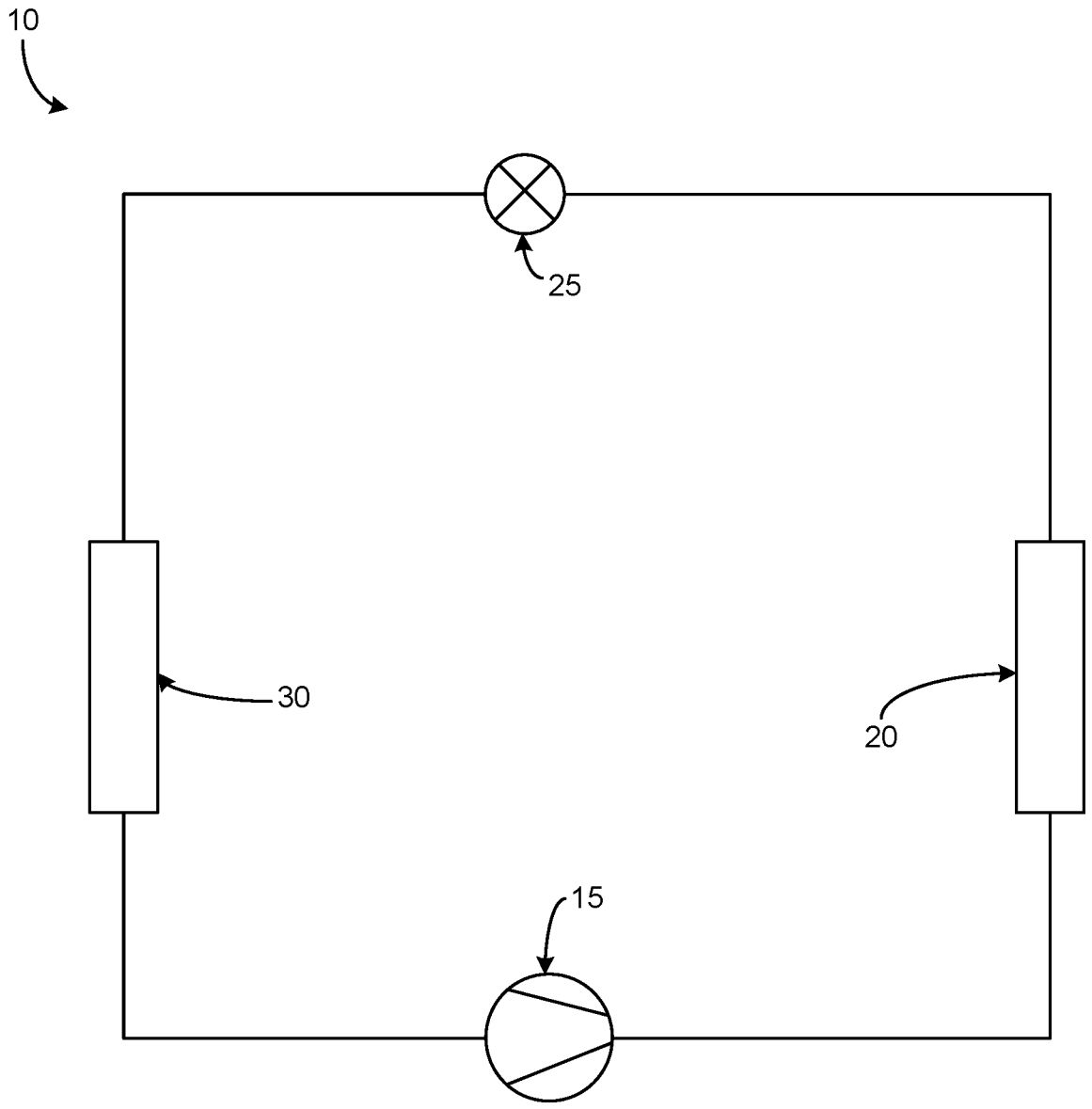
FIG. 1 is a schematic diagram of a heat transfer circuit, according to an embodiment.

FIG. 1 is a schematic diagram of a heat transfer circuit 10, according to an embodiment. The heat transfer circuit 10 generally includes a compressor 15, a condenser 20, an expansion device 25, and an evaporator 30. The compressor 15 can be, for example, a screw compressor such as the screw compressor shown and described in accordance with FIG. 2 below.

The heat transfer circuit 10 is exemplary and can be modified to include additional components. For example, in an embodiment the heat transfer circuit 10 can include an economizer heat exchanger, one or more flow control devices (e.g., valves or the like), a receiver tank, a dryer, a suction-liquid heat exchanger, or the like.

The heat transfer circuit 10 can generally be applied in a variety of systems used to control an environmental condition (e.g., temperature, humidity, air quality, or the like) in a space (generally referred to as a conditioned space). Examples of systems include, but are not limited to, heating, ventilation, air conditioning, and refrigeration (HVAC) systems, transport refrigeration systems, or the like.

The components of the heat transfer circuit 10 are fluidly connected. The heat transfer circuit 10 can be specifically configured to be a cooling system (e.g., an air conditioning system) capable of operating in a cooling mode. Alternatively, the heat transfer circuit 10 can be specifically configured to be a heat pump system which can operate in both a cooling mode and a heating/defrost mode.

Heat transfer circuit 10 operates according to generally known principles. The heat transfer circuit 10 can be configured to heat or cool heat transfer fluid or medium (e.g., a liquid such as, but not limited to, water or the like), in which case the heat transfer circuit 10 may be generally representative of a liquid chiller system. The heat transfer circuit 10 can alternatively be configured to heat or cool a heat transfer medium or fluid (e.g., a gas such as, but not limited to, air or the like), in which case the heat transfer circuit 10 may be generally representative of an air conditioner or heat pump.

In operation, the compressor 15 compresses a heat transfer fluid (e.g., refrigerant or the like) from a relatively lower pressure gas to a relatively higher-pressure gas. The relatively higher-pressure and higher temperature gas is discharged from the compressor 15 and flows through the condenser 20. In accordance with generally known principles, the heat transfer fluid flows through the condenser 20 and rejects heat to a heat transfer fluid or medium (e.g., water, air, fluid, or the like), thereby cooling the heat transfer fluid. The cooled heat transfer fluid, which is now in a liquid form, flows to the expansion device 25. The expansion device 25 reduces the pressure of the heat transfer fluid. As a result, a portion of the heat transfer fluid is converted to a gaseous form. The heat transfer fluid, which is now in a mixed liquid and gaseous form flows to the evaporator 30. The heat transfer fluid flows through the evaporator 30 and absorbs heat from a heat transfer medium (e.g., water, air, fluid, or the like), heating the heat transfer fluid, and converting it to a gaseous form. The gaseous heat transfer fluid then returns to the compressor 15. The above-described process continues while the heat transfer circuit is operating, for example, in a cooling mode (e.g., while the compressor 15 is enabled).

Figure 2:
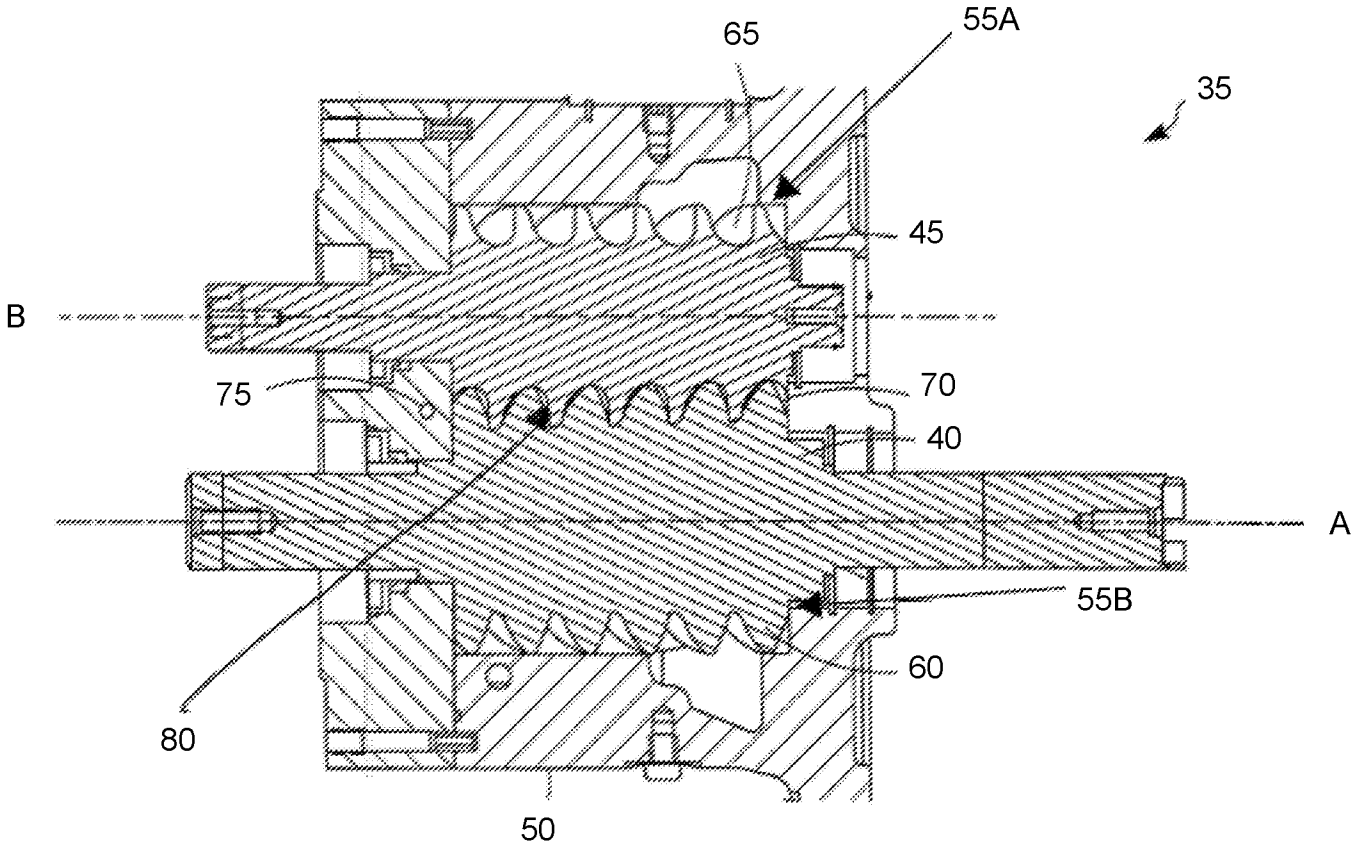
FIG. 2 is a screw compressor, according to an embodiment.

FIG. 2 illustrates an embodiment of a screw compressor 35 with which embodiments as disclosed in this Specification can be practiced. The screw compressor 35 can be used in the refrigerant circuit 10 of FIG. 1 (e.g., as the compressor 15). It is to be appreciated that the screw compressor 35 can be used for purposes other than in the refrigerant circuit 10. For example, the screw compressor 35 can be used to compress air or gases other than a heat transfer fluid or refrigerant (e.g., natural gas, etc.). It is to be appreciated that the screw compressor 35 includes additional features that are not described in detail in this Specification. For example, the screw compressor 35 can include a lubricant sump for storing lubricant to be introduced to the moving components (e.g., motor bearings, etc.) of the screw compressor 35.

The screw compressor 35 includes a compression mechanism. In an embodiment, the compression mechanism includes a first helical rotor 40 and a second helical rotor 45 disposed in a rotor housing 50. The rotor housing 50 includes a plurality of bores 55A and 55B. The plurality of bores 55A and 55B are configured to accept the first helical rotor 40 and the second helical rotor 45. The screw compressor 35 is not intended to be limiting regarding a number of helical rotors. It is to be appreciated that the concepts described in this Specification can be applicable to a screw compressor 35 including a single helical rotor or including more than two helical rotors.

The first helical rotor 40, generally referred to as the male rotor, has a plurality of spiral lobes 60. The plurality of spiral lobes 60 of the first helical rotor 40 can be received by a plurality of spiral grooves 65 of the second helical rotor 45, generally referred to as the female rotor. In an embodiment, the spiral lobes 60 and the spiral grooves 65 can alternatively be referred to as the threads 60, 65. The first helical rotor 40 and the second helical rotor 45 are arranged within the housing 50 such that the spiral grooves 65 intermesh with the spiral lobes 60 of the first helical rotor 40.

During operation, the first and second helical rotors 40, 45 rotate counter to each other. That is, the first helical rotor 40 rotates about an axis A in a first direction while the second helical rotor 45 rotates about an axis B in a second direction that is opposite the first direction. Relative to an axial direction that is defined by the axis A of the first helical rotor 40, the screw compressor 35 includes an inlet port 70 and an outlet port 75.

The rotating first and second helical rotors 40, 45 can receive a working fluid (e.g., heat transfer fluid such as refrigerant or the like) at the inlet port 70. The working fluid can be compressed between the spiral lobes 60 and the spiral grooves 65 (in a pocket 80 formed therebetween) and discharged at the outlet port 75. The pocket is generally referred to as the compression chamber 80 and is defined between the spiral lobes 60 and the spiral grooves 65 and an interior surface of the housing 50. In an embodiment, the compression chamber 80 may move from the inlet port 70 to the outlet port 75 when the first and second helical rotors 40, 45 rotate. In an embodiment, the compression chamber 80 may continuously reduce in volume while moving from the inlet port 70 to the discharge port 75. This continuous reduction in volume can compress the working fluid (e.g., heat transfer fluid such as refrigerant or the like) in the compression chamber 80.

Figure 3A:
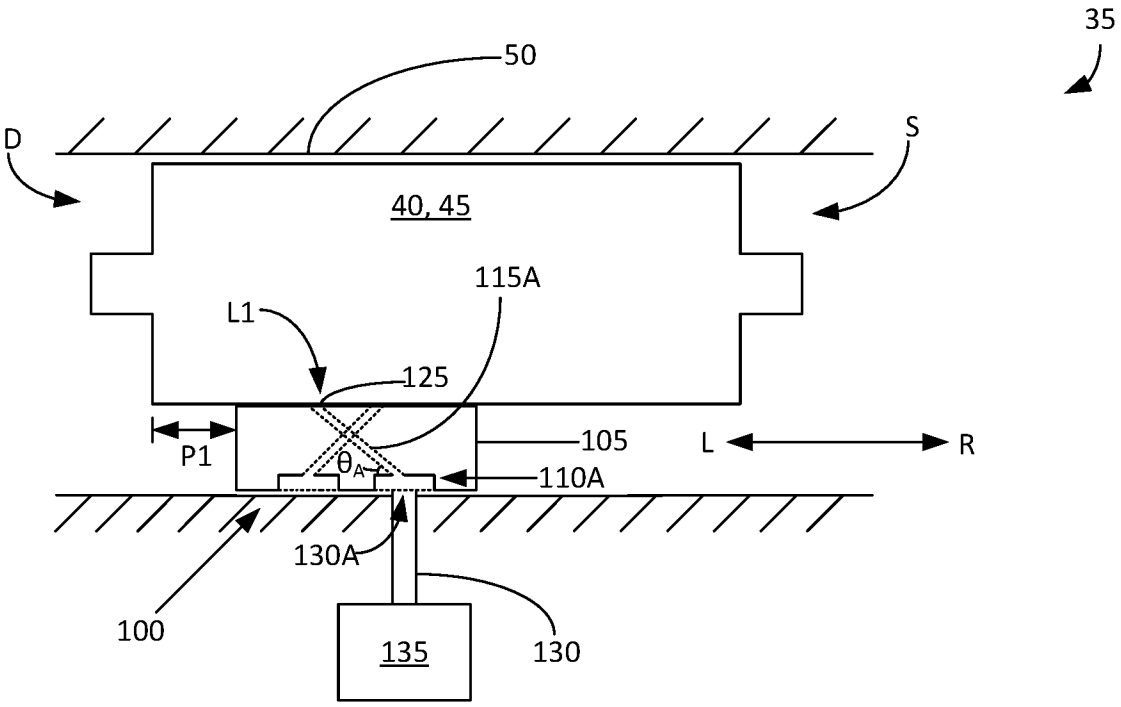
FIG. 3A is a schematic side view of a valve in a first position, according to an embodiment.
Figure 3B:
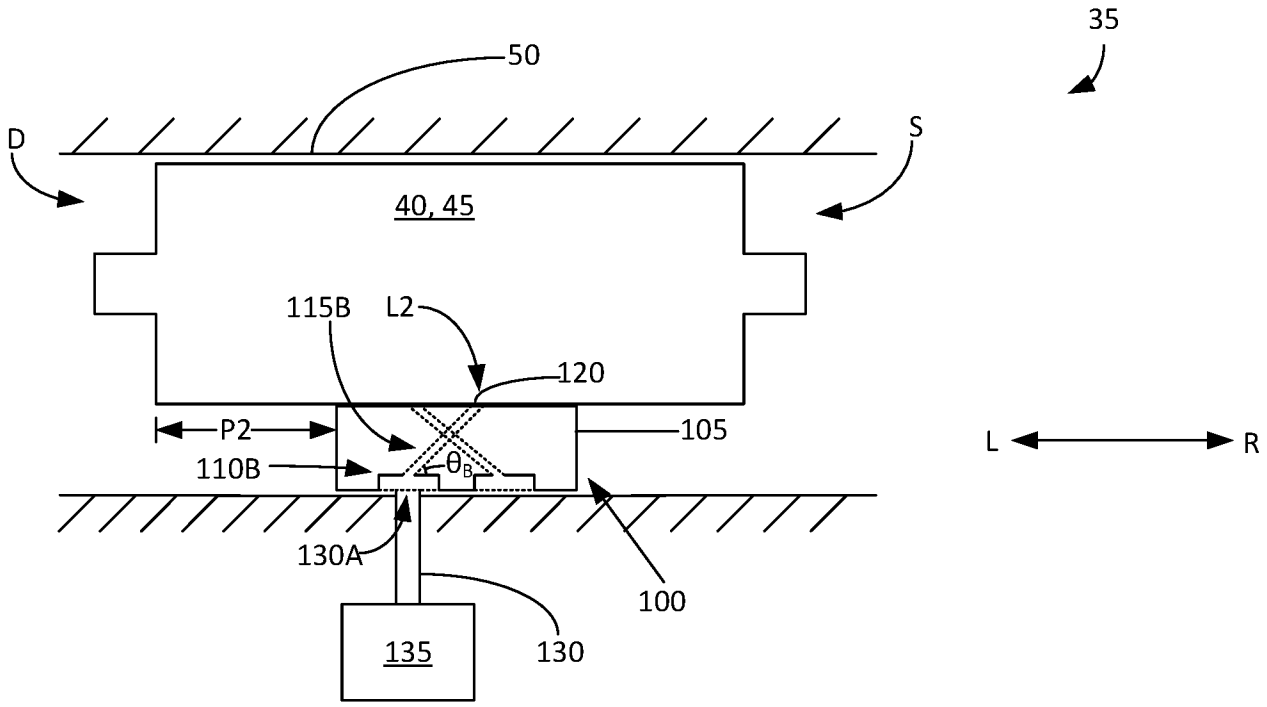
FIG. 3B is a schematic side view of the valve of FIG. 3A in a second position, according to an embodiment.

FIG. 3A is a schematic side view of a valve 100 in a first position, according to an embodiment. FIG. 3B is a schematic side view of the valve 100 in a second position, according to an embodiment.

The valve 100 may alternatively be referred to as the slide valve 100, the shuttle valve 100, or the like.

The valve 100 is translatable in the L and R directions (e.g., left and right with respect to the page). The valve 100 generally includes a first position (FIG. 3A) and a second position (FIG. 3B).

The valve 100 translates in the L and R directions based on a pressure differential (delta_P) in the screw compressor 35. The pressure differential delta_P can be a difference in pressure of the working fluid on a suction end S of the screw compressor 35 relative to a pressure of the working fluid on a discharge end D of the screw compressor 35.

In an embodiment, a pressure differential ratio can be determined from a difference in pressure of the working fluid at a condenser (e.g., the condenser 20 in FIG. 1) relative to a pressure of the working fluid at an evaporator (e.g., the evaporator 30 in FIG. 1).

At a relatively higher differential pressure ratio, the valve 100 may be in the first position (FIG. 3A). The first position is representative of an operational state of the screw compressor 35 in which the screw compressor 35 has a relatively higher volume ratio and is operating, for example, at a full load condition.

At a relatively lower differential pressure ratio, the valve 100 may be in the second position (FIG. 3B). The second position is representative of an operational state of the screw compressor 35 in which the screw compressor 35 has a relatively lower volume ratio and is operating at, for example, a part load condition.

In the first position (FIG. 3A), the valve 100 is a distance P1 from a discharge end D of the rotor housing 50. In the second position (FIG. 3B), the valve 100 is a distance P2 from the discharge end D of the rotor housing 50. The distance P2 is greater than the distance P1. It is to be appreciated that the actual distances P1 and P2 can vary according to a design of the screw compressor 35.

In the first position (FIG. 3A), slide member 105 is disposed so that a lubricant inlet 110A of the slide member 105 aligns with an outlet 130A of lubricant passage 130. When the lubricant inlet 110A is aligned with the outlet 130A of the lubricant passage 130, lubricant from a lubricant source 135 can be provided from the lubricant passage 130, through the inlet 110A, into lubricant passageway 115A. The lubricant, which is at a relatively higher pressure than a pressure in the rotor housing 50 at a location L1, can be provided through lubricant passageway 115A and into the rotor housing 50 via outlet 125 of the lubricant passageway 115A in the location L1. In an embodiment, the lubricant source 135 can be a high pressure side lubricant separator or the like. In an embodiment, a pump can be included to provide a sufficient pressure to the lubricant from the lubricant source 135. In such an embodiment, the lubricant source 135 can be at a relatively lower pressure.

The location L1 can be selected to, for example, optimize a location at which the lubricant is provided to rotors (rotors 40, 45 in FIG. 2) in the rotor housing 50 of the screw compressor 35 when the screw compressor 35 is operating at a relatively higher volume ratio. The location L1 is a fixed location, whereas the outlet 125 is variable along with the valve 100. Although L1 is fixed, the particular location can be selected according to a design of the screw compressor 35. The location L1 can be determined based on, for example, a diameter of the bores 55A, 55B (FIG. 2); a length of the rotors 40, 45; a differential pressure ratio at which the compressor is configured to operate; or the like. In an embodiment, the location L1 is selected to optimize a performance of the screw compressor 35 when operating at a relatively higher volume ratio.

The lubricant passageway 115A can, for example, be angled at an angle $\theta_A$ with respect to the inlet 110A. The angle $\theta_A$ can be measured according to a longitudinal axis extending along the lubricant passageway 115A. The angle $\theta_A$ can be selected to determine the location L1 at which the lubricant is provided to the rotors 40, 45. In an embodiment, the location L1 can be selected to optimize lubrication of the rotors 40, 45. The angle $\theta_A$ can then be selected to align the outlet 125 with the location L1 based on a location of the lubricant passage 130. In an embodiment, the angle $\theta_A$ can also be determined based on, for example, a manufacturability of the valve 100.

In the second position (FIG. 3B), slide member 105 is disposed so that a lubricant inlet 110B of the slide member 105 aligns with the outlet 130A of lubricant passage 130. When the lubricant inlet 110B is aligned with the outlet 130A of the lubricant passage 130, lubricant from the lubricant source 135 can be provided from the lubricant passage 130, through the inlet 110B, into lubricant passageway 115B. The lubricant, which is at a relatively higher pressure than a pressure in the rotor housing 50 at a location L2, can be provided through lubricant passageway 115B and into the rotor housing 50 via outlet 120 of the lubricant passageway 115B in the location L2.

The location L2 can be selected to, for example, optimize a location at which the lubricant is provided to rotors (rotors 40, 45 in FIG. 2) in the rotor housing 50 of the screw compressor 35 when the screw compressor 35 is operating at a relatively lower volume ratio. The location L2 is a fixed location, whereas the outlet 120 is variable along with the valve 100. The location L2 is relatively closer to the suction end S of the rotors 40, 45 than the location L1. The location L1 is relatively closer to the discharge end D of the rotors 40, 45 than the location L2.

The lubricant passageway 115B can, for example, be angled at an angle $\theta_B$ with respect to the inlet 110B. The angle $\theta_B$ can be measured according to a longitudinal axis extending along the lubricant passageway 115B. The angle $\theta_B$ can be selected to determine the location L2 at which the lubricant is provided to the rotors 40, 45. In an embodiment, the location L2 can be selected to optimize lubrication of the rotors 40, 45. The angle $\theta_B$ can then be selected to align the outlet 120 with the location L2 based on a location of the lubricant passage 130.

Figure 4:
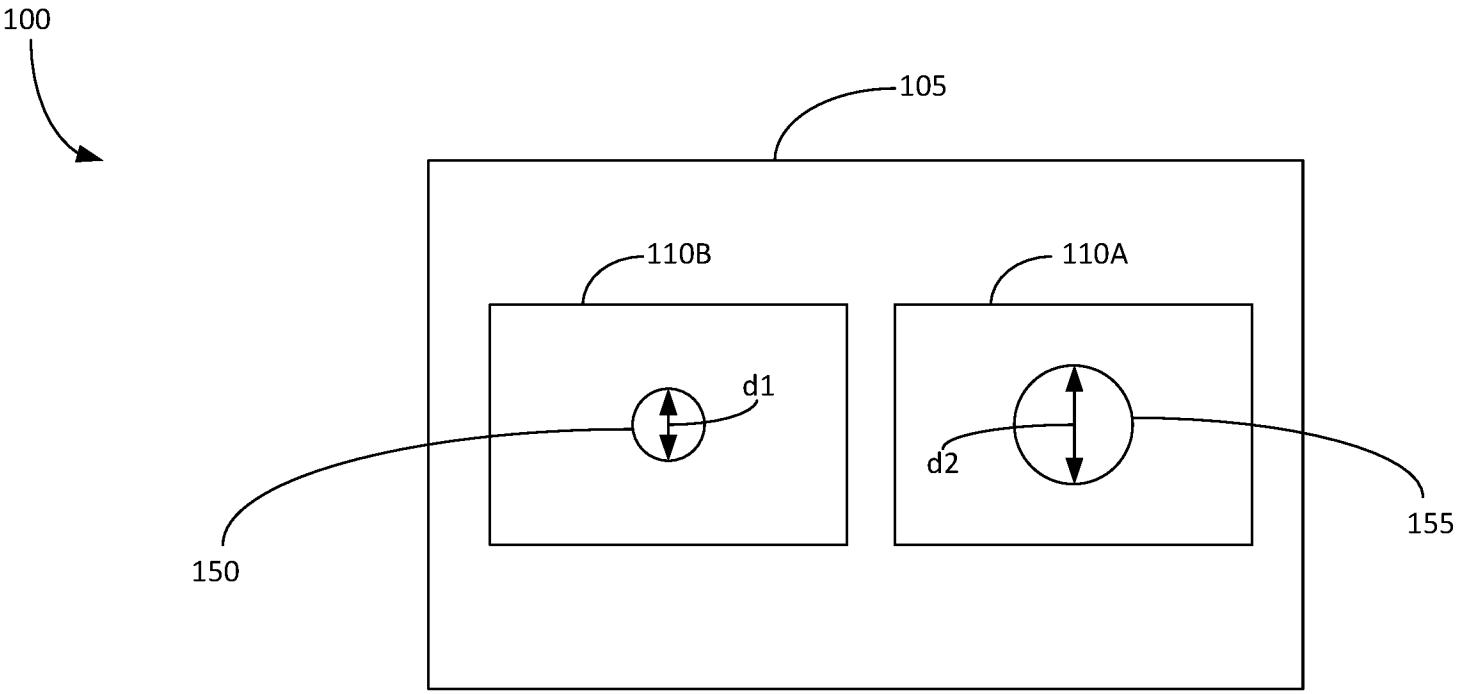
FIG. 4 is a schematic bottom view of the valve of FIGS. 3A and 3B, according to an embodiment.

The lubricant passageways 115A and 115B may have different sizes. FIGS. 3A and 3B are schematic and not drawn to scale. FIG. 4 shows a view in which the different sizes are apparent. For example, a higher quantity of lubricant may be desired when the lubricant is being provided to the location L1 than when the lubricant is being provided to the location L2. Accordingly, a diameter of the lubricant passageway 115A may be relatively larger than a diameter of the lubricant passageway 115B. FIG. 4 further illustrates this variation.

In an embodiment, a location of the outlets 120, 125 on the slide member 105 can be controlled to provide the lubricant in a particular direction. That is, the outlets 120, 125 can be arranged so that lubricant entering the rotor housing 50 is provided to impart a particular swirl direction.

FIG. 4 is a schematic bottom view of the valve 100, according to an embodiment. In FIG. 4, the bottom view includes the slide member 105 having the inlets 110A, 110B. As is visible within the inlets 110A, 110B, each of the inlets 110A, 110B includes an aperture 150, 155. The aperture 150 has a diameter d1 and the aperture 155 has a diameter d2. The diameter d1 is relatively smaller than the diameter d2. It is to be appreciated that the apertures 150, 155 are exaggerated in size to visually show differences between the two and that the apertures 150, 155 are not drawn to scale.

The aperture 150 is an inlet of the lubricant passageway 115B. The aperture 155 is an inlet of the lubricant passageway 115A. As discussed above, a diameter of the passageway 115B may be the diameter d1 of the aperture 150. In an embodiment, the diameter of the passageway 115B and the diameter d1 may be different. For example, the diameter of the passageway 115B can be designed to have a particular diameter to provide a desired flowrate to the fluid therethrough and the aperture 150 can be, for example, an insert into the passageway that could further control the output of the lubricant (e.g., a selected angle of entry or the like).

A diameter of the passageway 115A may be the diameter d2 of the aperture 155. In an embodiment, the diameter of the passageway 115A and the diameter d2 may be different. For example, the diameter of the passageway 115A can be designed to have a particular diameter to provide a desired flowrate to the fluid therethrough and the aperture 155 can be, for example, an insert into the passageway that could further control the output of the lubricant (e.g., a selected angle of entry or the like).

In operation of the screw compressor, the lubricant from lubricant source 135 is provided to the inlet 110A or the inlet 110B depending upon the positioning of the valve 100. For example, when the inlet 110A is aligned with the lubricant passage 130, lubricant will be provided to location L1. In this position, inlet 110B is not aligned with the lubricant passage 130, and accordingly, lubricant is not provided to location L2. Similarly, when the inlet 110B is aligned with the lubricant passage 130, lubricant will be provided to location L2. In this position, inlet 110A is not aligned with the lubricant passage 130, and accordingly, lubricant is not provided to location L1.

Aspects

It is noted that any of aspects 1-7 can be combined with any one of aspects 8-16 or 17-22. Any one of aspects 8-16 can be combined with any one of aspects 17-22.

Aspect 1. A screw compressor, comprising: a suction inlet that receives a working fluid to be compressed; a compression mechanism fluidly connected to the suction inlet that compresses the working fluid; a discharge outlet fluidly connected to the compression mechanism that outputs the working fluid following compression by the compression mechanism; and a slide valve, wherein the slide valve is movable between a first position and a second position, the first position corresponding to a high volume ratio and the second position corresponding to a low volume ratio, the slide valve including a plurality of lubricant passageways selectively connectable to a lubricant source, a first of the plurality of lubricant passageways configured to be selected to provide lubricant at the high volume ratio, and a second of the plurality of lubricant passageways configured to be selected to provide lubricant at the low volume ratio.

Aspect 2. The screw compressor of aspect 1, wherein the slide valve is movable between the first position and the second position based on a differential pressure ratio between the suction inlet and the discharge outlet.

Aspect 3. The screw compressor of one of aspects 1 or 2, wherein a first of the plurality of lubricant passageways has a first diameter and a second of the plurality of lubricant passageways has a second diameter.

Aspect 4. The screw compressor of aspect 3, wherein the first diameter and the second diameter are different.

Aspect 5. The screw compressor of one of aspects 1-4, wherein a first of the plurality of lubricant passageways is fluidly connected to the lubricant source in the first position and a second of the plurality of lubricant passageways is fluidly connected to the lubricant source in the second position.

Aspect 6. The screw compressor of one of aspects 1-5, wherein each of the plurality of lubricant passageways are angled relative to an inlet of the each of the plurality of lubricant passageways.

Aspect 7. The screw compressor of one of aspects 1-6, wherein in the first position, a first of the plurality of lubricant passageways provides lubricant at a location that is relatively closer to the discharge outlet of the screw compressor than to the suction inlet of the screw compressor, and in the second position, a second of the plurality of lubricant passageways provides lubricant at a location that is relatively closer to the suction inlet of the screw compressor than to the discharge outlet of the screw compressor.

Aspect 8. A refrigerant circuit, comprising: a compressor, a condenser, an expansion device, and an evaporator fluidly connected; and a lubricant source selectively connectable to the compressor; wherein the compressor includes: a suction inlet that receives a working fluid to be compressed; a compression mechanism fluidly connected to the suction inlet that compresses the working fluid; a discharge outlet fluidly connected to the compression mechanism that outputs the working fluid following compression by the compression mechanism; and a slide valve, wherein the slide valve is movable between a first position and a second position, the first position corresponding to a high volume ratio and the second position corresponding to a low volume ratio, the slide valve including a plurality of lubricant passageways selectively connectable to the lubricant source, a first of the plurality of lubricant passageways configured to be selected to provide lubricant at the high volume ratio, and a second of the plurality of lubricant passageways configured to be selected to provide lubricant at the low volume ratio.

Aspect 9. The refrigerant circuit of aspect 8, wherein the slide valve is movable between the first position and the second position based on a differential pressure ratio.

Aspect 10. The refrigerant circuit of one of aspects 8 or 9, wherein a first of the plurality of lubricant passageways has a first diameter and a second of the plurality of lubricant passageways has a second diameter.

Aspect 11. The refrigerant circuit of one of aspect 10, wherein the first diameter is different than the second diameter.

Aspect 12. The refrigerant circuit of one of aspects 8-11, wherein a first of the plurality of lubricant passageways is fluidly connected to the lubricant source in the first position and a second of the plurality of lubricant passageways is fluidly connected to the lubricant source in the second position.

Aspect 13. The refrigerant circuit of one of aspects 8-12, wherein each of the plurality of lubricant passageways are angled relative to an inlet of the each of the plurality of lubricant passageways.

Aspect 14. The refrigerant circuit of one of aspects 8-13, wherein in the first position, a first of the plurality of lubricant passageways provides lubricant at a location that is relatively closer to the discharge outlet of the screw compressor than to the suction inlet of the screw compressor, and in the second position, a second of the plurality of lubricant passageways provides lubricant at a location that is relatively closer to the suction inlet of the screw compressor than to the discharge outlet of the screw compressor.

Aspect 15. The refrigerant circuit of one of aspects 8-14, wherein the lubricant source is a lubricant separator.

Aspect 16. The refrigerant circuit of aspect 15, wherein the lubricant separator is a high pressure lubricant separator including a lubricant at or near a discharge pressure.

Aspect 17. A method for injecting lubricant to a compression chamber in a variable volume ratio screw compressor, comprising: aligning a first of a plurality of lubricant passageways in a slide valve of the screw compressor so that the first of the plurality of lubricant passageways is fluidly connected to a lubricant source of the screw compressor when the slide valve is in a first position; and aligning a second of the plurality of lubricant passageways in the slide valve of the screw compressor so that the second of the plurality of lubricant passageways is fluidly connected to the lubricant source of the screw compressor when the slide valve is in a second position.

Aspect 18. The method of aspect 17, wherein in the first position, the method includes operating the screw compressor at a high volume ratio.

Aspect 19. The method of one of aspects 17 or 18, wherein in the second position, the method includes operating the screw compressor at a low volume ratio.

Aspect 20. The method of one of aspects 17-19, wherein in the first position, the method includes providing lubricant from the lubricant source to a location that is relatively closer to a discharge end of the screw compressor than a suction end of the screw compressor.

Aspect 21. The method of one of aspects 17-20, wherein in the second position, the method includes providing lubricant from the lubricant source to a location that is relatively closer to a suction end of the screw compressor than a discharge end of the screw compressor.

Aspect 22. The method of one of aspects 17-21, wherein the first of the plurality of lubricant passageways is sized to control a flow of lubricant to the compression chamber.

The terminology used in this Specification is intended to describe particular embodiments and is not intended to be limiting. The terms "a," "an," and "the" include the plural forms as well, unless clearly indicated otherwise. The terms "comprises" and/or "comprising," when used in this Specification, specify the presence of the stated features, integers, steps, operations, elements, and/or components, but do not preclude the presence or addition of one or more other features, integers, steps, operations, elements, and/or components.

With regard to the preceding description, it is to be understood that changes may be made in detail, especially in matters of the construction materials employed and the shape, size, and arrangement of parts without departing from the scope of the present disclosure. This Specification and the embodiments described are exemplary only, with the true scope and spirit of the disclosure being indicated by the claims that follow.

What is claimed is:

1. A screw compressor, comprising:

a suction inlet that receives a working fluid to be compressed;

a compression mechanism fluidly connected to the suction inlet that compresses the working fluid, the compression mechanism including at least one helical rotor;

a discharge outlet fluidly connected to the compression mechanism that outputs the working fluid following compression by the compression mechanism; and a slide valve, wherein the slide valve is movable between a first position and a second position, the first position corresponding to a first volume ratio and the second position corresponding to a second volume ratio that is lower than the first volume ratio, the slide valve including a plurality of lubricant passageways selectively connectable to a lubricant source, a first of the plurality of lubricant passageways configured to be selected to provide lubricant at the first volume ratio, a second of the plurality of lubricant passageways configured to be selected to provide lubricant at the second volume ratio, and the first and the second of the plurality of lubricant passages being fluidly independent from each other in the slide valve.

2. The screw compressor of claim 1, wherein the slide valve is moved between the first position and the second position based on a differential pressure ratio between the suction inlet and the discharge outlet.

3. The screw compressor of claim 1, wherein the first of the plurality of lubricant passageways has a first diameter and the second of the plurality of lubricant passageways has a second diameter.

4. The screw compressor of claim 1, wherein in the first position, the first of the plurality of lubricant passageways is fluidly connected to the lubricant source, and the second of the plurality of lubricant passageways is not aligned with a lubricant passage for the lubricant source, and in the second position, the second of the plurality of lubricant passageways is fluidly connected to the lubricant source, and the first of the plurality of lubricant passageways is not aligned with the lubricant passage for the lubricant source.

5. The screw compressor of claim 1, wherein each of the plurality of lubricant passageways are angled relative to an inlet of the each of the plurality of lubricant passageways.

6. The screw compressor of claim 1, wherein in the first position, the first of the plurality of lubricant passageways provides lubricant at a location that is relatively closer to a discharge end of the screw compressor than to a suction end of the screw compressor, and in the second position, the second of the plurality of lubricant passageways provides lubricant at a location that is relatively closer to the suction end of the screw compressor than to the discharge end of the screw compressor.

7. A refrigerant circuit, comprising:

a compressor, a condenser, an expansion device, and an evaporator fluidly connected; and a lubricant source selectively connectable to the compressor;

wherein the compressor includes:

a suction inlet that receives a working fluid to be compressed, a compression mechanism fluidly connected to the suction inlet that compresses the working fluid, the compression mechanism including at least one helical rotor, a discharge outlet fluidly connected to the compression mechanism that outputs the working fluid following compression by the compression mechanism, and a slide valve, wherein the slide valve is movable between a first position and a second position, the first position corresponding to a first volume ratio and the second position corresponding to a second volume ratio that is lower than the first volume ratio, the slide valve including a plurality of lubricant passageways selectively connectable to the lubricant source, a first of the plurality of lubricant passageways configured to be selected to provide lubricant at the first volume ratio, a second of the plurality of lubricant passageways configured to be selected to provide lubricant at the second volume ratio, and the first and the second of the plurality of lubricant passages being fluidly independent from each other in the slide valve.

8. The refrigerant circuit of claim 7, wherein the slide valve is moved between the first position and the second position based on a differential pressure ratio.

9. The refrigerant circuit of claim 7, wherein the first of the plurality of lubricant passageways has a first diameter and the second of the plurality of lubricant passageways has a second diameter.

10. The refrigerant circuit of claim 7, wherein in the first position, the first of the plurality of lubricant passageways is fluidly connected to the lubricant source, and the second of the plurality of lubricant passageways is not aligned with a lubricant passage for the lubricant source, and in the second position, the second of the plurality of lubricant passageways is fluidly connected to the lubricant source, and the first of the plurality of lubricant passageways is not aligned with the lubricant passage for the lubricant source.

11. The refrigerant circuit of claim 7, wherein each of the plurality of lubricant passageways are angled relative to an inlet of the each of the plurality of lubricant passageways.

12. The refrigerant circuit of claim 7, wherein in the first position, the first of the plurality of lubricant passageways provides lubricant at a location that is relatively closer to a discharge end of the screw compressor than to a suction end of the screw compressor, and in the second position, the second of the plurality of lubricant passageways provides lubricant at a location that is relatively closer to the suction end of the screw compressor than to the discharge end of the screw compressor.

13. The refrigerant circuit of claim 7, wherein the lubricant source is a lubricant separator.

14. The refrigerant circuit of claim 13, wherein the lubricant separator is a high pressure lubricant separator including a lubricant at or near a discharge pressure.

15. A method for injecting lubricant to a compression chamber in a variable volume ratio screw compressor, comprising:

aligning a first of a plurality of lubricant passageways in a slide valve of the screw compressor so that the first of the plurality of lubricant passageways is fluidly connected to a lubricant source of the screw compressor when the slide valve is in a first position; and aligning a second of the plurality of lubricant passageways in the slide valve of the screw compressor so that the second of the plurality of lubricant passageways is fluidly connected to the lubricant source of the screw compressor when the slide valve is in a second position, and the first and the second of the plurality of lubricant passages being fluidly independent from each other in the slide valve.

16. The method of claim 15, wherein in the first position, the method includes operating the screw compressor at a first volume ratio, and operating the screw compressor at a second volume ratio that is less than the first volume ratio.

17. The method of claim 15, wherein in the first position, the method includes providing lubricant from the lubricant source to a location that is relatively closer to a discharge end of the screw compressor than a suction end of the screw compressor.

18. The method of claim 15, wherein in the second position, the method includes providing lubricant from the lubricant source to a location that is relatively closer to a suction end of the screw compressor than a discharge end of the screw compressor.

19. The method of claim 15, wherein the first of the plurality of lubricant passageways is sized to control a flow of lubricant to the compression chamber.

20. The method of claim 15, wherein aligning the first of the plurality of lubricant passageways in the slide valve of the screw compressor causes the second of the plurality of lubricant passageways to not be aligned with a lubricant passage for the lubricant source, and aligning the second of the plurality of lubricant passageways in the slide valve of the screw compressor causes the first of the plurality of lubricant passageways to not be aligned with the lubricant passage for the lubricant source.

* * * * *